US008251344B1

(12) United States Patent
Sorkin

(10) Patent No.: US 8,251,344 B1
(45) Date of Patent: Aug. 28, 2012

(54) POCKETFORMER WITH FLOW CHANNEL

(76) Inventor: Felix L. Sorkin, Houston, TX (US)

( * ) Notice: Subject to any disclaimer, the term of this patent is extended or adjusted under 35 U.S.C. 154(b) by 378 days.

(21) Appl. No.: 12/130,655

(22) Filed: May 30, 2008

(51) Int. Cl.
*E04C 5/08* (2006.01)

(52) U.S. Cl. ..... 249/177; 52/223.13

(58) Field of Classification Search ..... 52/223.13; 249/177, 63, 64, 175, 183, 2–9, 35
See application file for complete search history.

(56) References Cited

U.S. PATENT DOCUMENTS 3,552,379 A * 1/1971 Clarke ..... 126/262
3,844,697 A 10/1974 Edwards
4,970,993 A * 11/1990 Weiss et al. ..... 123/41.7
5,436,425 A 7/1995 Sorkin
5,897,102 A 4/1999 Sorkin
6,380,508 B1 * 4/2002 Sorkin ..... 219/121.39
6,393,781 B1 5/2002 Sorkin
7,174,685 B2 2/2007 Hayes
7,216,842 B2 * 5/2007 Watson ..... 249/177

* cited by examiner

*Primary Examiner* — Jeanette E Chapman
*Assistant Examiner* — Daniel Kenny
(74) *Attorney, Agent, or Firm* — Egbert Law Offices PLLC

(57) ABSTRACT

A pocketformer for use with an anchor body in post-tensioning concrete has a body having a first side and a second side and a first end and a second end and an interior, a front face formed adjacent the first end, and a tubular member formed in the interior of the body. The first side tapers from the second end to the first end. The second side tapers from the second end to the first end. The first side has an angle of taper greater than an angle of taper of the second side. The body has a generally hollow interior. The tubular member extends from the first end to the second end within the interior of the body. The angle of taper of the first side is approximately 45°.

13 Claims, 3 Drawing Sheets

POCKETFORMER WITH FLOW CHANNEL

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates to post-tensioning of concrete. More particularly, the present invention the relates to post-tension anchor systems. More particularly, the present invention the relates to pocketformers that are used for the creation of a pocket in a concrete structure adjacent to the end of the an anchor in an anchor system.

2. Description of Related Art Including Information Disclosed Under 37 CFR 1.97 and 37 CFR 1.98.

For many years, the design of concrete structures imitated typical steel design of column, girder and beam. With technological advances in structural concrete, however, its own form began to evolve. Concrete has the advantages of lower cost than steel, of not requiring fireproofing, and of its plasticity, a quality that lends itself to free flowing or boldly massive architectural concepts. On the other hand, structural concrete, though quite capable of carrying almost any compressive (vertical) load, is extremely weak in carrying significant tensile loads. It becomes necessary, therefore, to add steel bars, called reinforcements, to concrete, thus allowing the concrete to carry the compressive forces and the steel to carry the tensile (horizontal) forces.

Structures of reinforced concrete may be constructed with load-bearing walls, but this method does not use the full potentialities of the concrete. The skeleton frame, in which the floors and roofs rest directly on exterior and interior reinforced-concrete columns, has proven to be most economic and popular. Reinforced concrete framing is seemingly a quite simple form of construction. First, wood or steel forms are constructed in the sizes, positions, and shapes called for by engineering and design requirements. The steel reinforcing is then placed and held in position by wires at its intersections. Devices known as chairs and spacers are used to keep the reinforcing bars apart and raised off the form work. The size and number of the steel bars depends completely upon the imposed loads and the need to transfer these loads evenly throughout the building and down to the foundation. After the reinforcing is set in place, the concrete, a mixture of water, cement, sand, and stone or aggregate, of proportions calculated to produce the required strength, is placed, care being taken to prevent voids or honeycombs.

One of the simplest designs in concrete frames is the beam-and-slab. This system follows ordinary steel design that uses concrete beams that are cast integrally with the floor slabs. The beam-and-slab system is often used in apartment buildings and other structures where the beams are not visually objectionable and can be hidden. The reinforcement is simple and the forms for casting can be utilized over and over for the same shape. The system, therefore, produces an economically viable structure. With the development of flat-slab construction, exposed beams can be eliminated. In this system, reinforcing bars are projected at right angles and in two directions from every column supporting flat slabs spanning twelve or fifteen feet in both directions.

Reinforced concrete reaches its highest potentialities when it is used in pre-stressed or post-tensioned members. Spans as great as 100 feet can be attained in members as deep as three feet for roof loads. The basic principal is simple. In pre-stressing, reinforcing rods of high tensile strength wires are stretched to a certain determined limit and then high-strength concrete is placed around them. When the concrete has set, it holds the steel in a tight grip, preventing slippage or sagging. Post-tensioning follows the same principal, but the reinforcing is held loosely in place while the concrete is placed around it. The reinforcing is then stretched by hydraulic jacks and securely anchored into place. Pre-stressing is done with individual members in the shop and post-tensioning as part of the structure on the site.

In a typical tendon tensioning anchor assembly in such post-tensioning operations, there is provided a pair of anchors for anchoring the ends of the tendons suspended therebetween. In the course of installing the tendon tensioning anchor assembly in a concrete structure, a hydraulic jack or the like is releasably attached to one of the exposed ends of the tendon for applying a predetermined amount of tension to the tendon. When the desired amount of tension is applied to the tendon, wedges, threaded nuts, or the like, are used to capture the tendon and, as the jack is removed from the tendon, to prevent its relaxation and hold it in its stressed condition.

In such post-tension construction, the tendons are anchored and cut off just inside the face of the structure in what are termed "pockets." The "pockets" are simply voids in the concrete structure that provide access to the end of the anchor that is cemented within the concrete structure and to the tendon that extends through the anchor and out of the concrete structure. The pocket allows a device, such as a plasma cutter, to be used to cut the tendon near the end of the anchor body. U.S. Pat. No. 5,436,425, issued on Jul. 25, 1995 to the present inventor, discloses a method and apparatus for a plasma cutter that can be used to cut a tendon within a pocket. Once the end of the tendon is cut near the end of the anchor, the pocket is filled with a concrete grout so as to conceal the end of the anchor and the tendon from the elements and give the concrete structure a smooth outer surface.

Pockets are formed by using a pocketformer. A pocketformer is typically a plastic structure that is mounted to the end of an anchor before concrete is poured over the anchor and tendon. After concrete is poured and suitably hardened, a form board is removed and the pocketformer is removed from the end of the anchor so as to expose the pocket. Typical pocketformers as used in the prior art have a frustoconical surface on the exterior of the pocketformer. The frustoconical shape defines the pocket. A central tubular member is formed within the interior of the frustoconical portion. One end of the tubular member extends into the central bore of the anchor. The interior of the tubular member allows the tendon to extend therethrough. The tubular member is generally centered within the interior of the frustoconical portion. The surface of the anchor will abut the narrow end of the frustoconical portion. The wide end of the frustoconical portion will abut a surface of a form board. The tubular member extends through a hole in the form board. As such, the tendon will extend outwardly of the form board during the formation of the concrete structure.

One of the problems associated with the prior art pocketformers is the inability to accommodate tendon cutting devices so that the tendon can be cut near the end of the anchor within the pocket. In particular, prior art pocketformers have a problem accommodating a plasma torch for cutting the tendon near the end of the anchor.

Various patents have issued relating to pocketformers shaped so as to receive tendon cutting devices therein. For example, U.S. Pat. No. 3,844,697, issued on Oct. 28, 1974 to Edwards, discloses an anchorage assembly including an anchor having a hollow housing and means therein for engaging a stressing tendon passing therethrough. The assembly includes a hollow member removably attached to the anchor housing and to the concrete formwork. The hollow member fixes the relative position of the anchor housing to the formwork. The hollow member surrounds the tendon between the anchor housing and the formwork and is adapted and arranged to be detached from the anchor housing after the concrete has set. A cavity-forming spacer is provided which surrounds the member and is disposed between and seals against the anchor housing in the formwork to form a cavity in the concrete. The spacer is adapted and arranged to be removed from around the hollow member after the concrete has set.

U.S. Pat. No. 5,897,102, issued on Apr. 27, 1999 to the present inventor, describes a pocketformer apparatus for a post-tension anchor system. This pocketformer apparatus includes a tubular member with an outwardly flanged end, a securement member affixed to the tubular member, and a cup member having an interior opening such that the tubular member extends through the interior opening. The tubular member has an interior passageway extending from the flanged end to another end. The flanged end engages an anchor of the post-tension anchor system. The cup member is interposed between the flanged end and the securement member on the tubular member. The tubular member has an externally threaded area extending inwardly of the end opposite the flanged end. The securement member is threadedly received by the externally threaded area. An annular ring is formed on the flanged end of the tubular member so as to engage a receptacle formed in the encapsulation of the anchor. The securement member, the cup member and the tubular member are formed of a polymeric material.

U.S. Pat. No. 6,393,781, issued on May 28, 2002 to the present inventor, describes a pocketformer apparatus for post-tension construction. The pocketformer apparatus has an anchor member having a wedge-receiving cavity therein, a tubular member having a portion extending through the wedge-receiving cavity, a first securement member affixed to a first end of the tubular member, a cup member positioned over the tubular member, and a second securement member affixed to a second end of the tubular member. The cup member is interposed between the second securement member and the anchor member. The tubular member also extends through a hole in a form board. The second securement member is positioned on one side of the form board. The cup member and the anchor member are positioned on an opposite side of the form board. A tendon extends through the tubular member.

U.S. Pat. No. 7,174,685, issued on Feb. 13, 2007 to Hayes, discloses an apparatus and method for reducing corrosion in post-tensioning construction. An anchor is engageable with a post-tension tendon and comprises an anchor base and a sheath engaged with the anchor base, and a cap for sealing a portion of the tend within the anchor. The sheath can include an extension having a contact end distal from the anchor base for contacting the tendon as the tendon is inserted through the extension and the anchor base aperture. The cap can extend completely through the anchor base for connection of the anchor base of a sheath or sheath extension attached to the base. A pocketformer is attachable to the sheath for generating a void in the concrete.

One of the problems associated with these prior art pocketformer patents is that the pockets formed by the pocketformers tend to accumulate metal and heat generated by the use of a plasma cutter to cut the tendon in the pocket. Thus, there is need for a pocketformer that can form a pocket that channels the heat and metal particulate matter generated by a plasma cutter away from the anchorage system.

It is an object of the present invention to provide a pocketformer for an anchorage system.

It is another object of the present invention to provide to a pocketformer that easily fits over an end of an anchor body.

It is another object of the present invention to provide a pocketformer that forms a pocket that can channel heat generated by a plasma cutter away from the anchorage system.

It is still another object of the present invention to provide a pocketformer that creates a pocket that channels metal particulates away from anchorage system.

It is another object of the present invention to provide a pocketformer that creates a pocket that easily accommodates tendon-cutting devices.

It is another object of the present invention to provide a pocketformer that creates a pocket for accommodating a plasma cutter.

It is another object of the present invention to provide a pocketformer that is easily removed from hardened concrete.

It is another object of the present invention to provide a pocketformer that is lightweight and inexpensive.

These and other objects and advantages of the present invention will become apparent from a reading of the attached specification and appended claims.

BRIEF SUMMARY OF THE INVENTION

The present invention is a pocketformer for use with an anchor body in post-tensioning concrete comprising a body having a first side and a second side and a first end and a second end and an interior, a front face formed adjacent the first end, and a tubular member formed in the interior of the body. The first side tapers from the second end to the first end. The second side tapers from the second end to the first end. The first side has an angle of taper greater than an angle of taper of the second side. The body has a generally hollow interior. The tubular member extends from the first end to the second end within the interior of the body.

The front face has a connecting area formed thereon suitable for connecting the body to the anchor body. The connecting area has a lip extending outwardly from the front face. The lip is circular so as to suitably fit over an end of the anchor body. The tubular member is concentric with the lip of the connecting area. The angle of taper of the first side is approximately 45°. The tubular member has an inner diameter suitable for receiving a sheathed tendon therein. The body tapers constantly from the first side to the second side. The first side and the second side are curved.

The interior of the body has support structures formed therein. The support structures include a first strut radiating outwardly from a side of the tubular member to the first side of the body, a second strut radiating outwardly from an opposite side of the tubular member to the second side of the body, a cross strut extending between a third side and a fourth side of the body, and a transverse strut radiating outwardly from the tubular member to the third side and to the fourth side.

The front face has a protrusion formed thereon. The protrusion has a wall extending outwardly from the front face, and a cap affixed on the wall. The wall has a portion adjacent the connecting area. The portion has an angle of taper similar to the angle of taper of the first side.

DETAILED DESCRIPTION OF THE INVENTION

Figure 1:
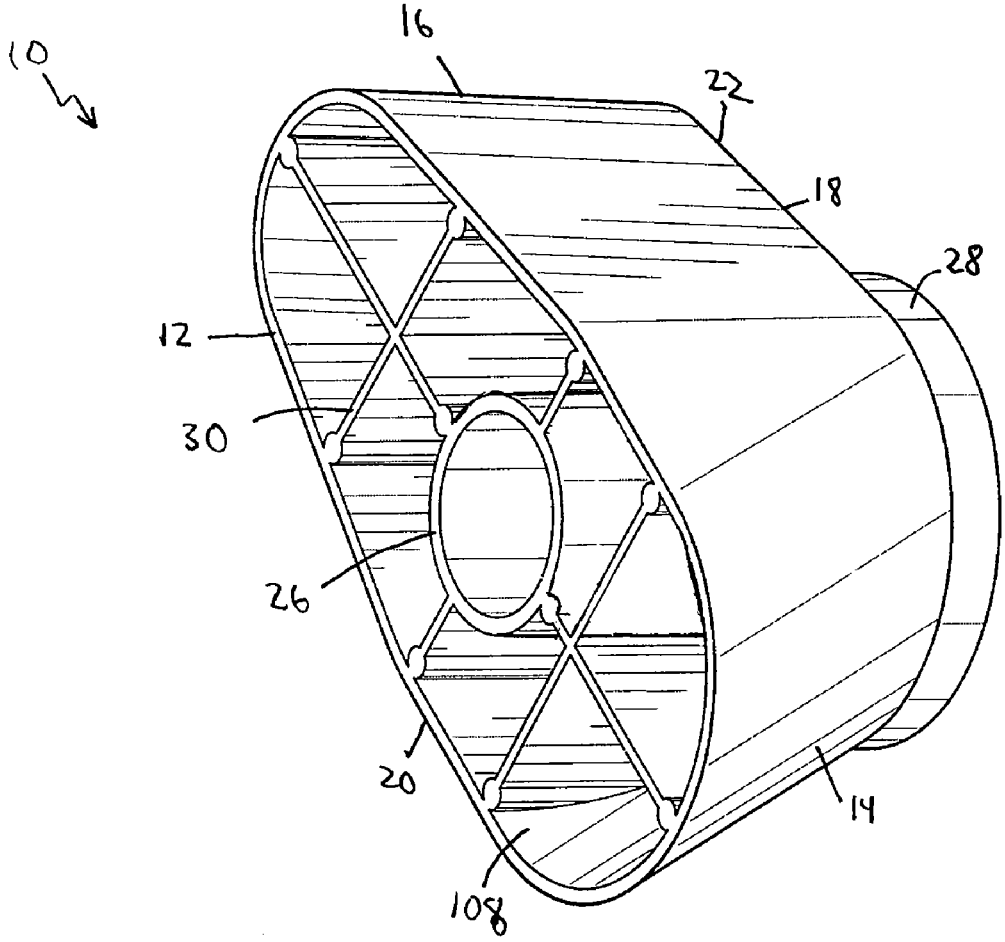
FIG. 1 shows a perspective view of the preferred embodiment of pocketformer of the present invention.

Referring to FIG. 1, there is shown a perspective view of the preferred embodiment of pocketformer 10 of the present invention. The pocketformer 10 has a body 12. The body 12 has a first side 14 and a second side 16. The body 12 has a first end 18 and a second end 20. A front face 22 is formed adjacent the first end 18 of the body 12. The front face 22 has a connecting area for connecting the pocketformer 10 to an end of an anchor body. The connecting area in the preferred embodiment is a lip 28 extending outwardly from the front face 22. The tubular member 26 is positioned in the interior 108 of the pocketformer 10. The tubular member 26 extends from the first end 18 to the second end 20 of the body 12. The tubular member 26 is positioned in an opening (not shown) in the front face 22. The interior 108 of the pocketformer 10 is substantially hollow except for support structures 30. The support structures 30 include a first strut 50 radiating outwardly from one side of the tubular member 26 to first side 14 and a second strut 52 radiating outwardly from an opposite side of tubular member 26 to second side 16. Cross-struts 54 and 56 extend between third side 62 and fourth side 64 of the body 12. Transverse struts 58 and 60 radiate outwardly from tubular member 26 toward respective sides 62 and 64. These struts 50, 52, 54, 56, 58, and 60 cause the walls of the body 12 to withstand the strong forces imparted by the concrete. Thus, support structures 30 are formed in the pocketformer 10 so as to give the pocketformer 10 rigidity as concrete is poured and hardened around the pocketformer 10. The first side 14 of the body 12 tapers inwardly from the second end 20 to the first end 18. Likewise, the second side 16 tapers inwardly from the second end 20 to the first end 18. The first side 14 has an angle of taper greater than the angle of taper of the second side 16. The pocketformer 10 is integrally formed of a polymeric material by an injection molding process.

Figure 2:
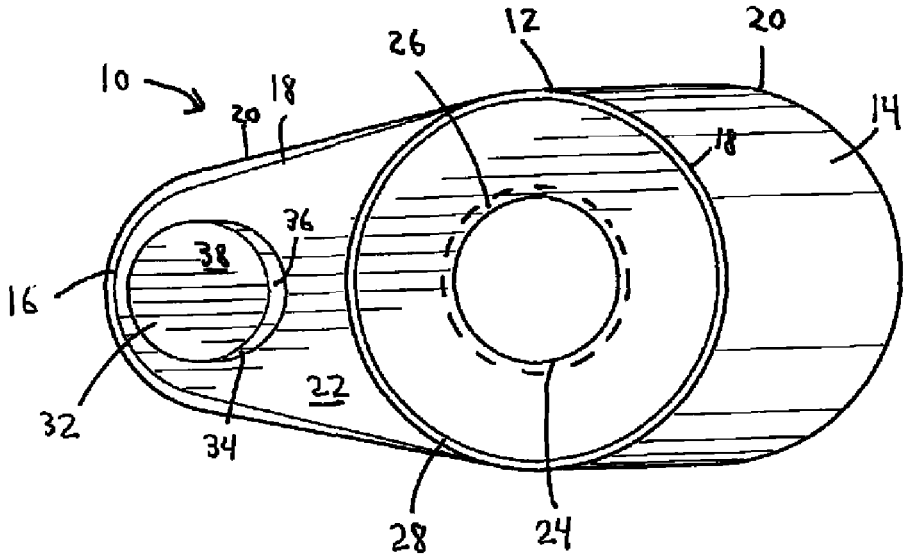
FIG. 2 shows a first end view of the pocketformer of the present invention.

Referring to FIG. 2, there is shown an end elevational view of the pocketformer 10 of the present invention. As can be seen, the body 12 has a first side 14 and a second side 16. The first side 14 can be seen as tapering from the first end 18 to the second end 20 at a much greater angle than the second side 16 tapers from the first end 18 to the second end 20. In the preferred embodiment, the angle of taper of the first side 14 is approximately 45°. The front face 22 can be seen on the first end 18. The lip 28 and the protrusion 32 are formed on the front face 22. The protrusion has a wall 34 and a cap 38. A portion 36 of the wall 34 is adjacent the lip 28. The tubular member 26, as shown by a broken circle, is positioned in opening 24 in the front face 22. The diameter of the opening 24 and the inner diameter of the tubular member 26 are substantially the same. The diameter of the opening 24 and the inner diameter of the tubular member 26 are suitably sized for receiving a sheathed tendon therein. Both the first side 14 and the second side 16 are curved. The first side 14 is larger than the second side 16. It can be seen how the body 12 tapers in size from the first side 14 to the second side 16. It can be seen that the lip 28 is circular so as to fit over an end of a anchor body. The opening 24 is concentric with the lip 28. The lip 28, the opening 24, and the tubular member 26 are all substantially circular. The tubular member 26 extends perpendicular to the front face 22.

Figure 3:
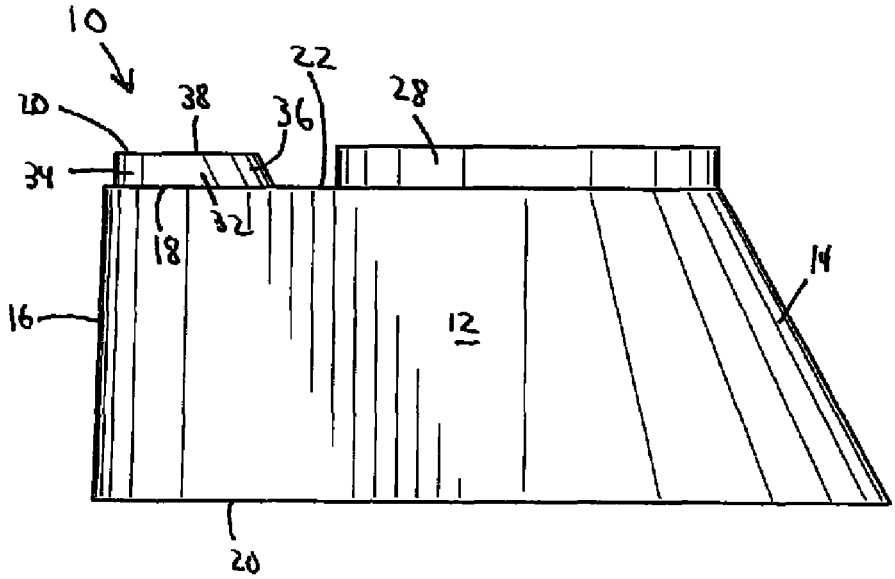
FIG. 3 shows a side elevational view of the pocketformer of the present invention.

Referring to FIG. 3, there is shown an elevational view of the pocketformer 10 of the present invention. The protrusion 32 can be seen as extending outwardly from the front face 22. The protrusion 32 has a wall 34 that is substantially circular. The wall 34 has a portion 36 adjacent the lip 28 of the connecting area. The portion 36 of the wall 34 has an angle of taper similar to the angle of taper of the first side 14 of the body 12. The lip 28 can be seen as extending outwardly from the front face 22. FIG. 3 shows that the angle of taper of the first side 14 from the second end 20 to the first end 18 is greater than the angle of taper of the second side 16 from the second end 20 to the first end 18.

Figure 4:
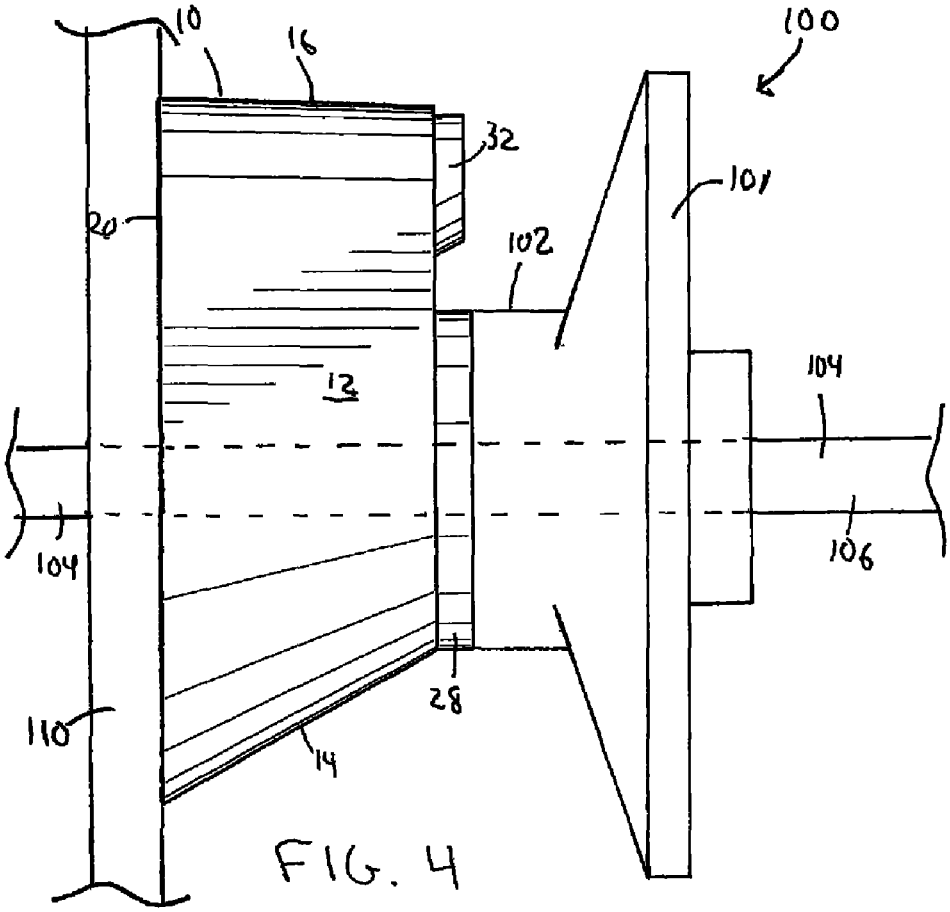
FIG. 4 shows a side elevational view of the preferred embodiment of the assembly of the present invention.

Referring to FIG. 4, there is shown an elevational view of the preferred embodiment of the assembly 100 of the present invention. The assembly 100 has an anchor body 101. A tendon 104 having a sheathing 106 extends through a cavity in the anchor body 101 and through the pocketformer 10. The second end 20 of the body 12 of the pocketformer 10 is placed next to a formboard 110. The formboard 110 has a hole that allows the tendon 104 to pass therethrough. Once the lip 28 of the pocketformer 10 is placed around the end 102 of the anchor body 101 and once the formboard 110 is placed adjacent to the second end 20 of the pocketformer 10, concrete is poured around the assembly 100 and hardens. Once the concrete has hardened, the formboard 110 is removed from the second end 20 of the pocketformer 10, and the pocketformer 10 is removed from the end 102 of the anchor body 101, leaving a pocket in the concrete structure. The remaining pocket in the concrete structure has the shape of the pocketformer 10 of the present invention, including the tapered sides 14 and 16 and the protrusion 32.

Figure 5:
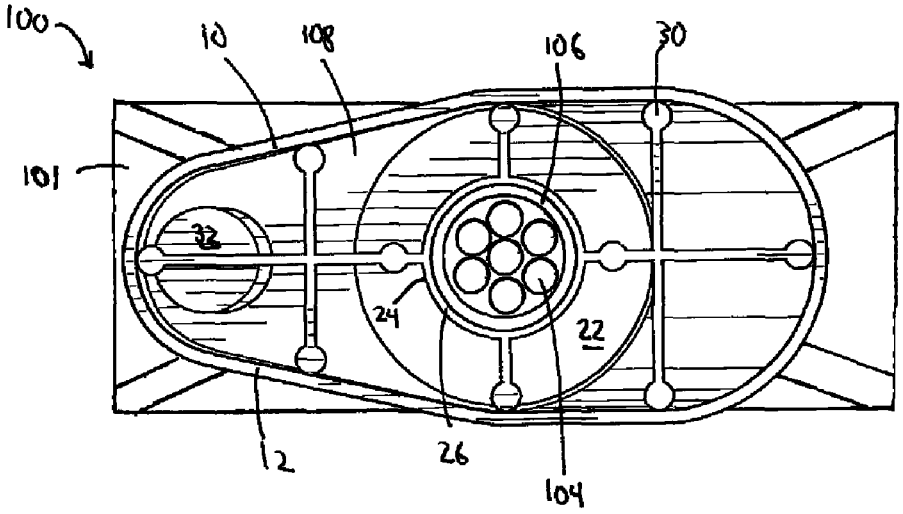
FIG. 5 shows an end view of the assembly of the present invention.

Referring to FIG. 5, there is shown an end view of the assembly 100 of the present invention. The tendon 104 can be seen as extending through the interior 108 of the pocketformer 10. In particular, the tendon 104 extends within the tubular member 26 of the pocketformer 10. The tendon 104 has a sheathing 106. Because the tendon 104 has a sheathing 106, it is called a sheathed tendon. The sheathed tendon 104 is substantially circular, as is the tubular member 26. The tubular member 26 can be seen as extending perpendicular to the front face 22. Tubular member 26 can be seen as being positioned in the opening 24 of the front face 22.

The angle of taper of the first side 14 creates a pocket in a concrete structure that has a channel for hot air to escape from the pocket when the tendon 104 is cut using a plasma cutter. While cutting a tendon with a plasma cutter, metal is vaporized. A plasma cutter uses compressed air to help cut the tendon. Thus, the compressed air of the plasma cutter along with the vaporized metal created by cutting a tendon can easily escape out of the pocket by the channel formed by the first side 14 of the pocketformer 10. Moreover, the channel formed that allows air to escape helps prevent the build up of heat within the pocket while using a plasma cutter.

The foregoing disclosure and description of the invention is illustrative and explanatory thereof. Various changes in the details of the illustrated construction can be made within the scope of the present claims without departing from the true spirit of the invention. The present invention should only be limited by the following claims and their legal equivalents.

I claim:

1. A pocketformer for use with an anchor body in post-tensioning concrete comprising:

a body having a first side and a second opposite side and a first end and a second end, said first side tapering from said second end to said first end, said second side tapering from said second end to said first end, said first side having an angle of taper greater than an angle of taper of said second side, said angle of taper being approximately 45°, said body having a generally hollow interior;

a front face formed adjacent said first end; and a tubular member formed in said interior of said body, said tubular member extending from said first end to said second end within said interior of said body.

2. The pocketformer of claim 1, said front face having a connecting area formed thereon suitable for connecting said body to the anchor body.

3. The pocketformer of claim 2, said connecting area having a lip extending outwardly from said front face, said lip being circular so as to suitably fit over an end of the anchor body, said tubular member being concentric with said lip of said connecting area.

4. The pocketformer of claim 1, said interior of said body having support structures formed therein.

5. The pocketformer of claim 4, said support structures comprising:

a first strut radiating outwardly from a side of said tubular member to said first side of said body;

a second strut radiating outwardly from an opposite side of said tubular member to said second side of said body;

a cross strut extending between a third side and a fourth side of said body; and a transverse strut radiating outwardly from said tubular member to said third side and to said fourth side.

6. The pocketformer of claim 1, said tubular member having an inner diameter suitable for receiving a sheathed tendon therein.

7. The pocketformer of claim 1, said body tapering constantly from said first side to said second side.

8. The pocketformer of claim 1, said first side and said second side being curved.

9. A pocketformer assembly for use in post-tensioning of concrete comprising:

an anchor body having a cavity therein;

a tendon extending through said cavity of said anchor body; and a pocketformer connected to said anchor body, said tendon passing through an interior of said pocketformer, said pocketformer comprising:

a body having a first side and a second side and a first end and a second end, said first side tapering from said second end to said first end, said second side tapering from said second end to said first end, said first side having an angle of taper greater than an angle of taper of said second side, said angle of taper of said first side being approximately 45°, said body having a generally hollow interior;

a front face formed adjacent said first end, said front face connected to said anchor body, said front face having a lip extending outwardly from said front face, said lip being circular so as to fit over an end of the anchor body; and a tubular member formed in said interior of said body, said tubular member extending from said first end to said second end within said interior of said body, said interior of said body having support structures formed therein, said support structures comprising:

a first strut radiating outwardly from a side of said tubular member to said first side of said body;

a second strut radiating outwardly from an opposite side of said tubular member to said second side of said body;

a cross strut extending between a third side and a fourth side of said body; and a transverse strut radiating outwardly from said tubular member to said third side and to said fourth side.

10. The pocketformer of claim 9, said tendon having a sheathed portion, said sheathed portion received in an interior of said tubular member.

11. The pocketformer of claim 9, said body tapering continuously from said first side to said second side.

12. The pocketformer of claim 9, said first side and said second side being curved.

13. The pocketformer of claim 9, said front face having a protrusion formed thereon, said protrusion comprising:

a wall extending outwardly from said front face, said wall having a portion adjacent said connecting area, said portion having an angle of taper similar to said angle of taper of said first side; and a cap affixed on said wall.

* * * * *